United States Patent [19]

Bylo

[11] 4,085,695

[45] Apr. 25, 1978

[54] LOGISTICAL SUPPORT OF OFFSHORE DRILLING FACILITIES

[76] Inventor: John J. Bylo, 7272 Willoughby Ave., Los Angeles, Calif. 90046

[21] Appl. No.: 678,079

[22] Filed: Apr. 19, 1976

Related U.S. Application Data

[60] Continuation-in-part of Ser. No. 649,645, Jan. 16, 1976, which is a division of Ser. No. 439,375, Feb. 4, 1974, Pat. No. 3,934,532, which is a continuation-in-part of Ser. No. 187,537, Oct. 7, 1971, Pat. No. 3,793,974, which is a continuation-in-part of Ser. No. 794,938, Jan. 29, 1969, abandoned.

[51] Int. Cl.[2] ..... B63B 35/40

[52] U.S. Cl. ..... 114/260; 114/264

[58] Field of Search ..... 114/.5 D, 43.5 VC, 43.5 R, 114/44, 72, 73, 77 R, 77 A, 235 R, 206, 258, 259, 260, 263, 264, 265, 242, 293; 61/64, 65, 86–94; 214/12, 13, 14, 15, 38

[56] References Cited

U.S. PATENT DOCUMENTS

| | | | |
|---|---|---|---|
| 3,139,197 | 6/1964 | Bylo | 114/77 A |
| 3,191,568 | 6/1965 | Schroeder et al. | 114/43.5 VC |
| 3,349,742 | 10/1967 | Bylo | 114/77 R |
| 3,399,792 | 9/1968 | Chester | 214/12 |
| 3,417,721 | 12/1968 | Vienna | 114/43.5 VC |
| 3,727,414 | 4/1973 | Davies | 114/.5 D |

FOREIGN PATENT DOCUMENTS

| | | | |
|---|---|---|---|
| 1,272,302 | 8/1961 | France | 114/235 R |

*Primary Examiner*—Trygve M. Blix
*Assistant Examiner*—Jesus D. Sotelo
*Attorney, Agent, or Firm*—Christie, Parker & Hale

[57] ABSTRACT

A system for logistical support of an offshore drilling facility from a shore-based supply location includes a plurality of modular work deck units, a self-propelled vessel, and a plurality of one dock facilities at the supply location. The vessel releasably mates with and supports any one of the work deck units and cargo carried thereby. The vessel is ballastable for increasing and decreasing the draft of the vessel when the vessel is mated with a work deck unit sufficiently that the vessel can ballast down from a separately supported work deck unit and move out from thereunder. The dock facilities are defined for movement thereinto of the vessel with a work deck unit thereon. The dock facilities are each defined for engaging and supporting a work deck unit therein both for loading and unloading of cargo to and from the deck unit and for transfer to and from the vessel in response to ballasting of the vessel relative to the dock facility. Further, the drilling facility is arranged for receiving and discharging a work deck unit from and to the vessel.

10 Claims, 6 Drawing Figures

LOGISTICAL SUPPORT OF OFFSHORE DRILLING FACILITIES

CROSS-REFERENCE TO RELATED APPLICATIONS

This application is a continuation-in-part of co-pending application Ser. No. 649,645 filed Jan. 16, 1976 as a division of application Ser. No. 439,375 filed Feb. 4, 1974 and now U.S. Pat. No. 3,934,532. Application Ser. No. 439,375 was a continuation-in-part of application Ser. No. 187,537 filed Oct. 7, 1971 and now U.S. Pat. No. 3,793,974, and the latter application was a continuation-in-part of Ser. No. 794,938 filed Jan. 19, 1969 and now abandoned.

FIELD OF THE INVENTION

This invention pertains to marine transport systems and, more particularly, to a marine transport system for logistical support of offshore drilling facilities from shore-based supply locations and in which modularized cargo hold units are used.

BACKGROUND OF THE INVENTION

THE STATE OF THE ART

Exploration for and production of oil and gas reserves underlying the oceans of the world are performed from offshore drilling facilities which usually are located some distance from the adjacent shore line. The drilling facility may be a tower erected on the sea floor and extending to a work platform above the water surface, or the drilling facility may be a floating platform. The floating platform may be either of the drillship type or of the semi-submersible type; in either event, the facility is located for long periods, perhaps even permanently, offshore often at substantial distances from the nearest available port or supply location.

An industry has developed to logistically support offshore drilling facilities. As presently defined, this industry is composed generally of independent contractors to the owners and operators of the offshore drilling facilities. These independent contractors own fleets of one or more supply vessels which, depending upon the areas in which they operate, are usually designed with reference to the particular climatic and sea conditions likely to be encountered. A typical offshore supply vessel is either designed specifically for a given limited purpose or as a compromise amongst the competing factors pertinent to other requirements of the logistics for offshore drilling facilities. An example of a special purpose vessel is a crew boat which is designed to ferry personnel to and from offshore drilling facilities. An example of a multifunction design compromise offshore support vessel is a work boat which, at various times in its life, is called upon to transport tubular goods such as drill pipes or production casing to the offshore drilling facility, or to transport food or dry or liquid bulk goods and supplies to the drilling facility, or to serve as an anchor-handling boat in connection with the initial positioning and mooring of a floating offshore drilling facility. Because a workboat typically constitutes a design compromise to enable the vessel to serve multiple functions, it is of less than optimum characteristics for the performance of any one function.

An offshore support vessel, such as a crew boat or a work boat, constitutes a substantial investment to its owner. Such vessels are idle much of their useful life since they must be tied up at the dockside at the shore-based supply location to take on and to discharge cargo; they are similarly idle for even longer periods in the course of discharging cargo to and receiving cargo from an offshore drilling facility. Transfer of cargo between an offshore drilling facility and a support vessel is generally a time consuming and hazardous process because the cargo must be transferred piecemeal by use of boom cranes and the like mounted on the drilling facility. These cargo transfer operations at the drilling facility often must be performed with respect to a support vessel which is pitching, heaving, and rolling as the vessel responds to passing wave trains. It is not uncommon for support vessels to be damaged or for cargo to be lost during this transfer process.

The specific patent references considered in the preparation of this patent application are as follows:

U.S. Pat. Nos. 10,843, Young, 1854; 1,076,068, Schleieher, 1913; 1,226,055, Bohn, 1917; 2,371,149, Bylo, 1945; 2,894,650, Black, 1959; 3,139,197, Bylo, 1964; 3,191,568, Schroeder, 1965; 3,349,742, Bylo, 1967; 3,399,792, Chester, 1968; 3,417,721, Vienna, 1968; 3,557,742, Gainsley, 1971; 3,793,974, Bylo, 1974; 3,934,532, Bylo, 1976; 1,022,374, Pedrick, 1966.

SUMMARY OF THE INVENTION

This invention provides significant economic and practical movements in the mechanics of logistical support of offshore drilling facilities from shore-based supply locations. Economically, this invention is of significance both to the owner or operator of the offshore drilling facility and to the operator of the support vessel. This invention enables a support vessel to be in productive use a maximum amount of its useful life in actually moving cargo or personnel between offshore drilling facilities and adjacent shore-based supply locations. This invention enables the support vessel to be optimally configured for any activity it is called upon to perform at any given time. This invention minimizes the time which a support vessel must spend taking on or discharging cargo at a shore-based location; more significantly, it minimizes the time which the vessel must occupy in a cargo transfer operation at an offshore drilling facility.

This invention incorporates, either directly or with the modifications described below, many of the structures and procedures described in my prior U.S. Pat. Nos. 2,371,149, 3,139,197, 3,349,742, 3,793,974, and 3,934,532.

My prior patents describe marine transport structures and systems in which the cargo space of a vessel is occupied substantially exclusively by one or more modular hold units which are of standard modular design, at least over the lower exterior portions thereof. A vessel is designed to mate with the lower portions of any one of the cargo hold units and to secure the hold units laterally in position on the vessel so that, during operation of the vessel to move the hold units from one place to another, the hold units cannot shift on the vessel. The vessels described in my prior patents are basically self-propelled receptacles for the deck units and are composed principally of a hull, appropriate machinery, necessary navigation and equipment space, and minimal crew accommodations. In a preferred marine transport system according to my prior patents, a number of vessels are used with a greater plurality of deck units to move cargo between adjacent ports in an integrated multiport transport system, the deck units being transferred from one vessel to another in passing through any given port in the system. At least some, and preferably all, of the ports in the system are equipped with dock facilities arranged to support any one of the deck units above a slip into which a vessel may move and to support the deck unit independently of the presence of a vessel in the slip. The vessels include ballast systems which enable the vessels to buoyantly move up and down into and out of receiving and supporting engagement with a deck unit supported in the dock facility, thereby to accomplish the transfer of a given deck unit from a given vessel to and from the dock facility. While the deck units are supported in the dock facilities in the absence of a vessel, cargo may be worked to and from the deck unit. The vessels are thereby freed from lying idle in port during cargo handling operations and spend a maximum possible percentage of their useful life in actually transferring the deck units and cargo therein between ports in the system.

As noted, this invention proceeds from the principles, structures and methods described in my prior patents and provides an improved system for logistical support of offshore drilling facilities from a shore-based supply location. Generally, speaking, apparatus according to this invention includes a plurality of modular work deck units of generally rectangular plan shape. The deck units are of generally uniform external configuration and dimension over the bottom and the lower side and end portions thereof. A self-propelled vessel is provided and has a deck which is dimensioned and configured in cooperation with the deck units to releasably mate with and to support any one of the deck units and cargo or equipment carried thereby. The vessel and the deck unit mate so that the deck units are substantially laterally fixed in position on the vessel. The vessel includes ballast means which are operable for increasing and decreasing the draft of the vessel when the vessel is mated with a work deck unit. The ballast means is of sufficient capacity that the vessel can be ballasted down from a deck unit separately supported in a dock facility and thereafter moved out from under the supported deck unit. A plurality of facilities are provided at the supply location. Each dock facility is defined in cooperation with the vessel and the deck units for movement thereinto of the vessel with a deck unit on the vessel. Each dock facility is also arranged for engaging and supporting a work deck unit therein and for loading and unloading of cargo to and from the deck unit as well as for transfer to and from the vessel in response to the ballasting of the vessel relative to the dock facility. At the offshore drilling facility, means are provided for receiving and discharging a work deck unit from and to the vessel.

DESCRIPTION OF THE ACCOMPANYING DRAWINGS

The above-mentioned and other features of this invention are more fully set forth in the following detailed description of presently preferred embodiments of the invention, which description is presented with reference as appropriate to my prior patents and with reference to the accompanying drawings wherein.

DESCRIPTION OF THE ILLUSTRATED EMBODIMENTS

Figure 1:
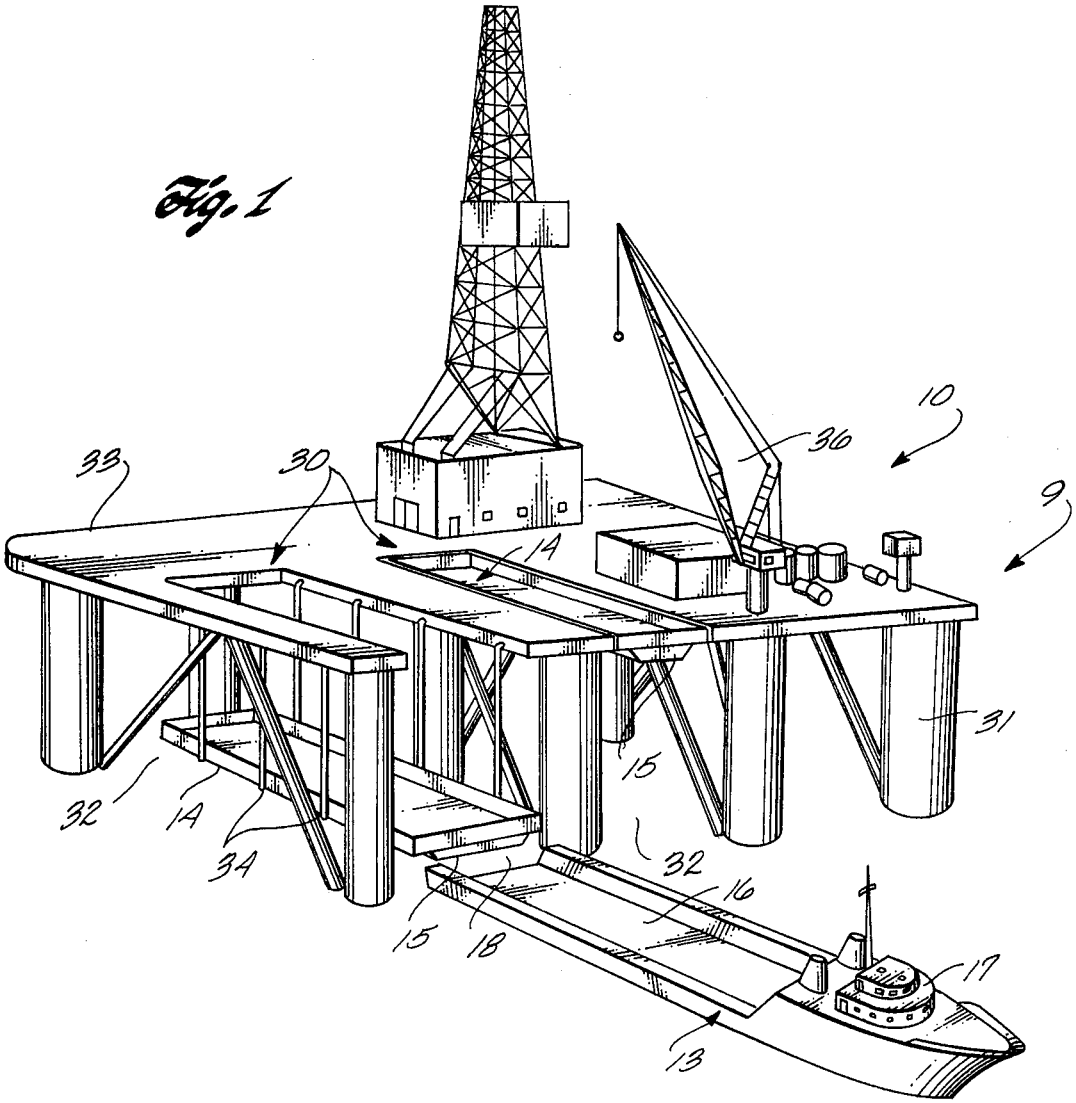
FIG. 1 is a perspective view of an improved offshore support vessel in the course of transferring a work deck unit to or from an offshore drilling facility.
Figure 2:
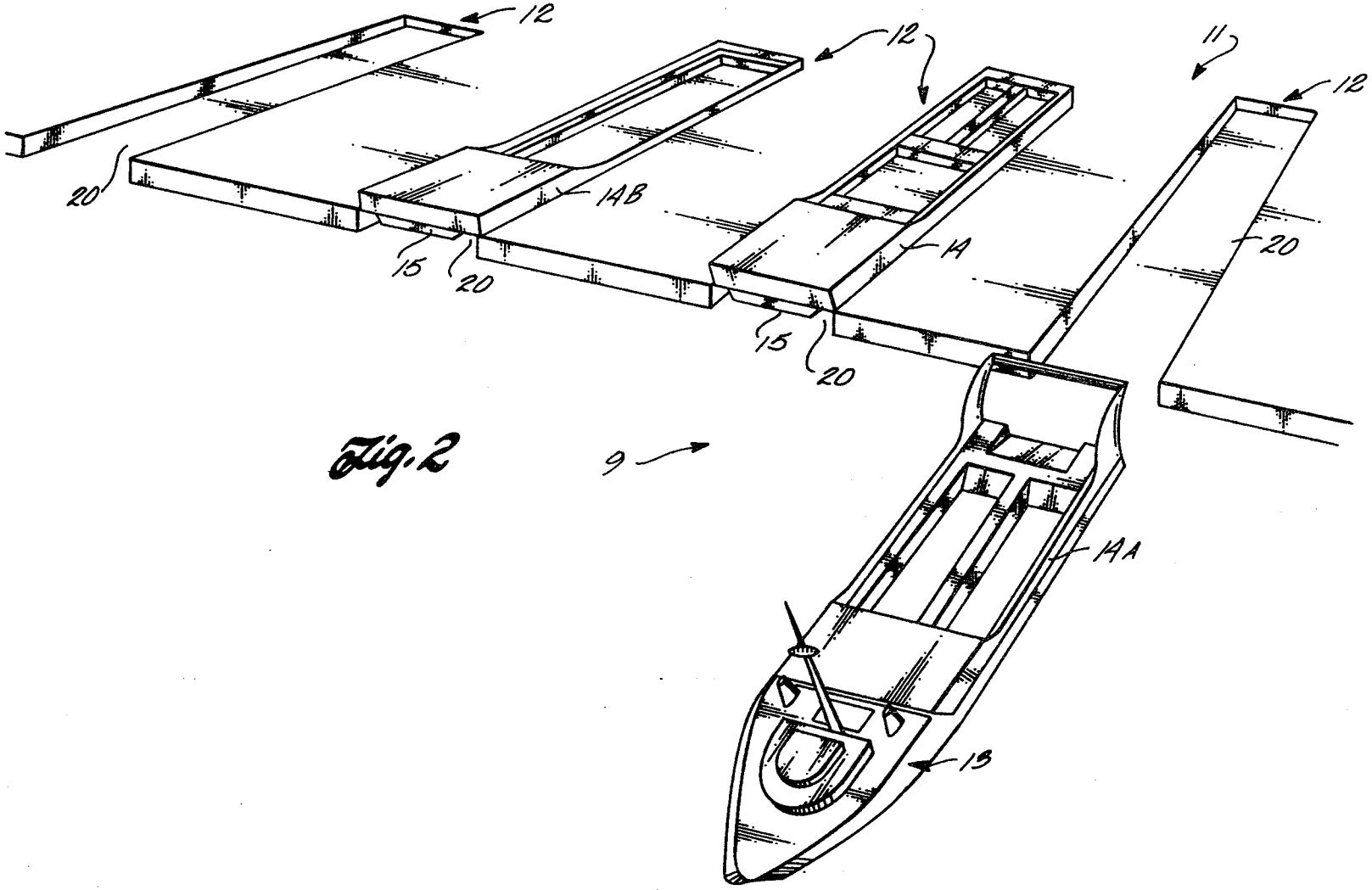
FIG. 2 is a perspective view of a shore-based supply location showing the dock facilities at the supply location.

FIGS. 1 and 2 show a presently preferred offshore drilling platform support and supply system 9 according to this invention which includes at least one offshore drilling platform 10, a shore-based supply location 11 which includes a plurality of dock facilities 12, at least one self-propelled vessel 13 (sometimes referred to herein as a "bottom"), and a plurality of modular work deck units 14. The term "offshore drilling platform" is used broadly with reference to platform 10 and encompasses both a platform used for actual exploratory or production drilling of a subsea oil or gas reserve and also a production which is operated to produce oil or gas from the subsea reserve after the drilling processes have been completed.

Within the overall system, vessels 13 function in a manner analogous to forklift trucks to pick up a work deck unit from either the drilling platform or the shore-based supply location (base) and to move the deck unit to the other of the platform or base.

As shown in the drawings, the work deck units 14 are of generally rectangular configuration when viewed in plan, i.e., either from above or below, and define as a part of their structure a central longitudinal depending rib 15 which is of uniform dimension and configuration as between the several work deck units of the system. Each work deck unit is defined to project laterally horizontally outwardly from the rib along the elongate sides of the rib. The overall width of each of the deck units may be greater than the beam of the self-propelled vessels in the system. While the different work deck units contemplated by this invention are described in greater detail hereinafter, it is noted at this point that the upper portions of each work deck unit is configured, arranged and equipped in conformance with a specialized function in which each work deck unit serves in the overall system. As between the several work deck units, however, the deck units are all of generally uniform external configuration and dimension over both the bottom thereof, specifically as to ribs 15, and also over the lower side and end portions thereof.

Each self-propelled support vessel, such as vessel 13 shown in FIG. 1, defines an upwardly open, elongate, longitudinally aligned deck well 16 aft of a forward bridge and accommodations structure 17 below which, within the interior of the vessel hull, is located the appropriate machinery for propulsion of the vessel and for operation of the ballast system which is included in the vessel as hereinafter described. Well 16 preferably occupies a major portion of the length of the vessel and is open through the stern of the vessel as best shown at 18 in FIG. 1 (see also FIG. 4). The geometry of the well, both in terms of its overall dimensions and its local features, is defined in mirror image conformance to the configuration of the ribs 15 defined by each of work deck units 14. As noted above, the beam of vessel 13 may be equal to or less than but preferably not greater than the width of any of the work deck units. The beam of the vessel relative to the width of the work deck units is determined depending upon the particular nature of the dock facility (compare FIGS. 2 and 3) which is provided at base 11.

As more fully described in my prior patents (see particularly U.S. Pat. Nos. 2,371,149, 3,139,197, and 3,793,974) each vessel 13 includes sufficient internal ballast space to enable the vessel, when mated with a loaded work deck unit, to be ballasted down (to increase draft) sufficiently to enable the vessel, when positioned in a dock facility, to transfer the weight of the work deck unit and its load to the dock facility and thereafter to further increase draft sufficiently that the vessel can move out from under the separately supported work deck unit. Also, the ballast capacity of each vessel is sufficient so that the bottom when bare, i.e., when not engaged with a work deck unit, can be given sufficient draft that it can move into a dock facility below a separately supported loaded work deck unit and to ballast up (to decrease draft) through a distance sufficient to enable the vessel to move into engagement with the work deck unit and to transfer from the dock facility to the vessel the weight of the work deck unit and its load. Depending upon the nature of the deck unit-to-vessel receiving and discharging station at the offshore drilling platform 10, the ballast capacity of the vessel may be required to be adequate to enable the vessel to change draft sufficiently to discharge a deck unit from or to the vessel into the water, and also to move empty under and to ballast up to a floating deck unit to assume its weight. Where a work deck unit is to be deposited in the water at an offshore drilling platform, the deck unit is watertight over its lower portions and has sufficient buoyancy to support itself and its load. As to the nature of the ballast system which is included in each vessel 13 in a support system according to this invention, reference is made to my prior U.S. Pat. No. 3,793,974.

As shown in FIG. 2, at the base or onshore supply location 11, a plurality of dock facilities 12 are provided. Each dock facility defines a slip 20 of sufficient length, width, and water depth that a support vessel 13 may enter the slip, preferably stern to in the case of the dock facilities shown in FIG. 2, and either discharge or take on a work deck unit by ballasting down or up, respectively, out of or into load transferring engagement with a work deck unit separately supported in the dock facility. In view of the content of my prior patents, it is believed unnecessary to describe in detail herein the specific cooperative structural relationships which can be used between the dock facilities, the vessels, and the work deck units to enable the deck units to be separately supported above the slip in each dock facility. In this connection, reference is made, for example, to my prior U.S. Pat. Nos. 2,371,149, 3,139,197, and 3,793,974. U.S. Pat. No. 2,371,149 is of interest where the width of the deck units is greater than the beam of any of vessels 13 so that the work deck units may be transferred between the vessels and the dock facilities simply by ballasting of the vessels. U.S. Pat. No. 3,139,197 describes arrangements at a dock facility which provide for vertical movement of a deck unit in the dock facility supplemental to the vertical movement of the vessel due to ballasting. Any of the dock facility and deck unit interfaces described in either of these two patents, or in my later U.S. Pat. No. 3,793,974, may be used as desired within the scope of this invention.

Figure 3:
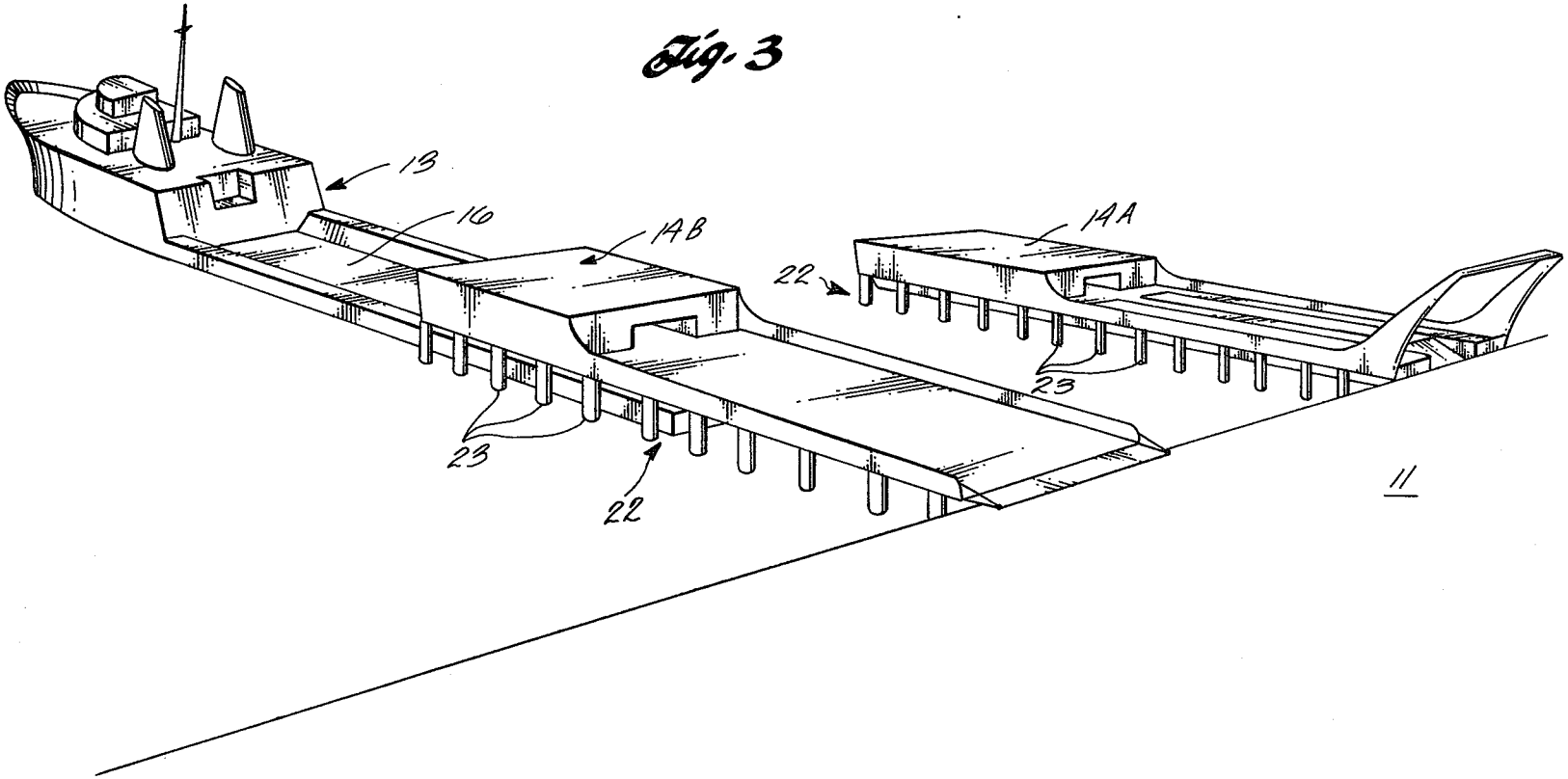
FIG. 3 is a perspective view of alternate dock facilities at a shore-based supply location.

FIG. 3 illustrates another dock facility 22 which may be provided at a supply base in a system according to this invention. Dock facilities 22 include pairs of parallel rows of pilings 23, the rows being spaced from each other an amount corresponding to the width of slip 20 as shown in FIG. 2. The upper ends of the pilings serve as the structural features for registering with the portions of the several work deck units which extend laterally outwardly beyond the beam of vessel 13 for engaging and supporting the work deck units separately from the vessels.

As noted above, the several work deck units in any offshore drilling platform support and supply system according to this invention may all be different in structural organization and layout in their upper aspects while being of uniform configuration and dimension over their lower aspects for cooperation of any work deck unit with any vessel 13 in the system. The variability of the upper aspects of a work deck unit enables any given work deck unit to be designed and equipped for optimum conformance to a specialized purpose to which that work deck unit is assigned within the system. For example, in FIGS. 2 and 3, work deck unit 14A is specifically defined, especially in its aft portions, as an anchor-handling unit for use in placing the mooring anchors for a floating offshore drilling platform according to practices which are standard in the offshore drilling industry. Those aspects of work deck unit 14A which are specifically adapted to the handling of anchors will readily be recognizable from the accompanying drawings to persons involved in the offshore drilling industry and the related support industry, to which persons this invention is addressed.

Figures 4, 5:
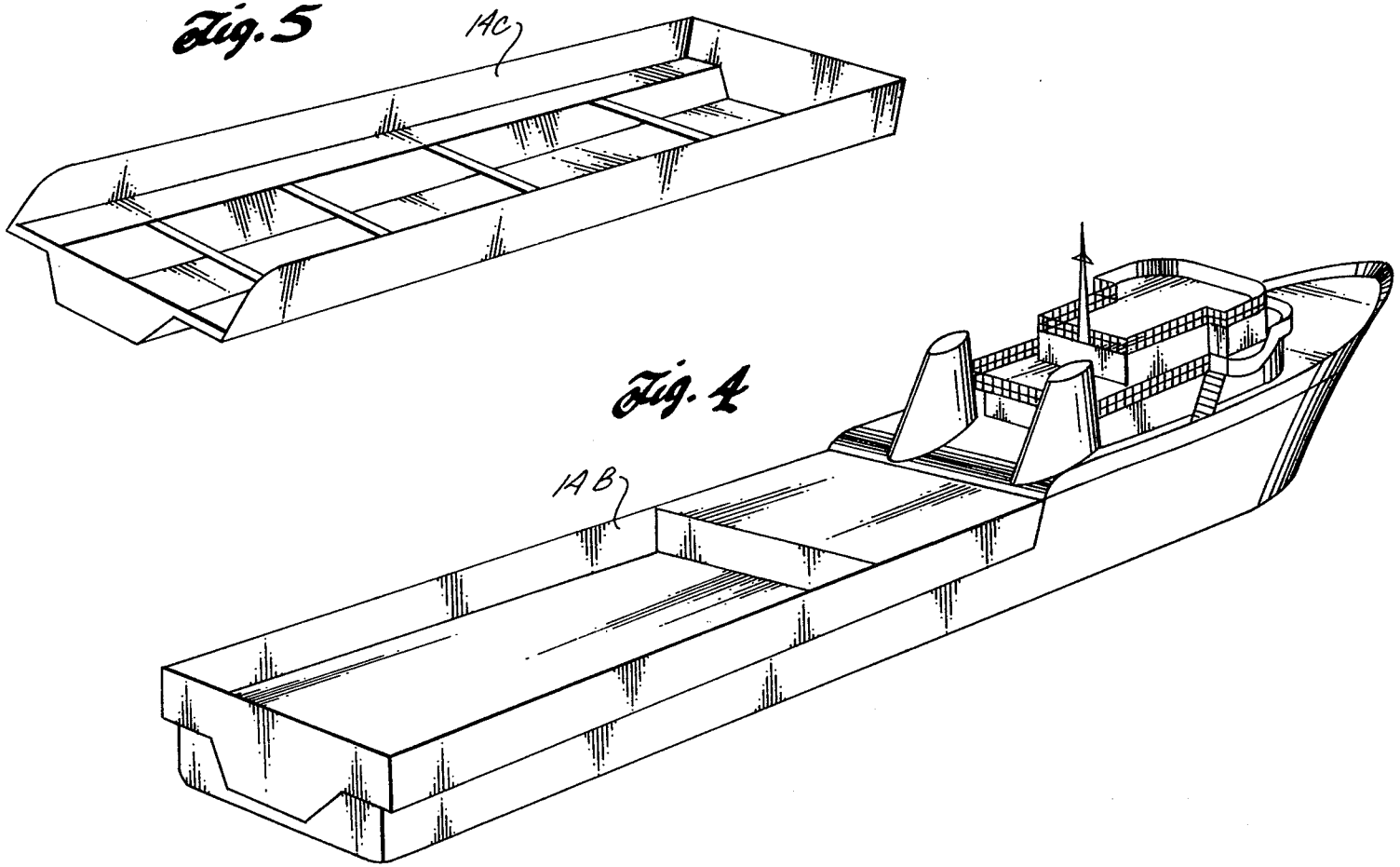
FIG. 4 is a perspective view of a general purpose work deck unit mated with the support vessel.
FIG. 5 is a perspective view of another work deck unit.

Similarly, work deck units 14B shown in FIGS. 2, 3 and 4 are specifically designed and equipped as cargo platforms for the receipt and transport of general stores to an offshore drilling platform. Work deck unit 14C, shown in FIG. 5, is designed as a cargo platform for the transport of tubular goods, i.e., steel drill pipe, well casing, production tubing, or the like, to an offshore drilling platform. While not shown specifically in the accompanying drawing, it is apparent that additional work deck units in the system can be designed and equipped operationally for service as a diving station, on-site laboratories (as, for example, a Schlumberger logging equipment and analysis facility for use on an offshore drilling platform specifically during drilling operations), or as an equivalent of a crew boat.

In most instances, worldwide, where offshore drilling operations are being conducted, many offshore drilling platforms are located in a localized offshore geographical area for support and supply out of one or a few ports or bases. A typical example of this situation is encountered in the Gulf of Mexico and offshore from California adjacent Santa Barbara and Ventura. This invention, as described above, makes it possible for a given offshore platform support and supply concern to make maximum use of its vessels which normally are the most expensive pieces of equipment owned by such an operator. It will be apparent that, according to this invention, a given offshore support and service contractor can service substantially more offshore drilling platforms more effectively on a better schedule with a given capital investment, or the contractor can effectively service more efficiently a given number of offshore platforms with significantly reduced capital investment. This is so because each vessel 13 is essentially continuously in use moving between the shore-based supply location and the several offshore drilling platforms adjacent the supply location. This is so because the vessel, upon arriving at the shore-based supply location, can rapidly enter a slip at an open dock facility, deposit the work deck unit carried by the vessel, leave the first slip and back or otherwise enter into an adjacent slip at another dock facility below a different loaded deck unit which may be of the same or a different type as the deck unit previously deposited, transfer the loaded deck unit from the second dock facility to the vessel, and leave from the second dock facility to another offshore drilling platform. At the supply location, the different work deck units owned by the operator can be loaded at leisure with the material to be dispatched to any one of the adjacent offshore drilling platforms when either the same or a different vessel in the fleet next arrives at the supply location. The economies realized by the operator of a support and supply concern are particularly discernible when it is realized that an anchor-handling vessel, as presently defined, is usefully occupied on its specialized tasks only a small percentage of the time.

The economies produced for an offshore support and supply operator are particularly great at the "other end of the line," i.e., at offshore drilling platform 10 which, according to this invention, includes a vessel-to-deck unit receiving and discharging station 30. In FIG. 1, offshore drilling platform 10 is illustrated as a semi-submersible platform in which multiple surface piercing pylons 31 are arranged to provide slips 32 between them and into which a loaded vessel 13 may move into position below the operations deck 33 of the platform which is supported above the water surface by the pylons. In the arrangement shown in FIG. 1, the receiving and discharging stations 30 are defined as openings in the platform operations deck, the openings being dimensioned to correspond to the overall transverse and longitudinal dimensions of the work deck units 10. The receiving and discharging stations also include appropriate elevator equipment, such as winches (not shown) and cables 34 the ends of which carry suitable connectors capable of being lowered into engagement with suitable fixtures defined in the work deck units for receiving the weight of a work deck unit and its load from a vessel. The weight of a work deck unit and its load is transferred between the platform and a support vessel either by ballasting the vessel downwardly from the separately supported position of the work deck unit as shown in FIG. 1, or by taking in the cables to raise the work deck unit to the level of the platform operations deck, or by a combination of both practices. In any event, at the offshore drilling platform, a loaded work deck unit is rapidly discharged from a newly arrived vessel and held in an appropriate position at the platform for unloading of cargo and the like from the work deck as by use of a boom crane 36 included within the equipment of the platform. As shown in FIG. 1, the best practice of this invention is believed to be achieved where the platform includes two or more receiving and discharging stations 30, whereby the vessel upon discharging to the platform a newly arrived work deck unit and its cargo may move into the position below a second work deck unit which is to be sent back to the shore-based supply location. In this manner vessel 13 is not required to return empty from the platform to the supply base, with resulting economies in the use of both the vessel and the work deck units.

Those persons in the industries to which this invention is addressed will readily recognize that the principles of this invention may be used to great advantage with existing offshore drilling platforms which do not include work deck unit receiving and discharging stations of the type shown in FIG. 1. Accordingly, this invention contemplates that the work deck receiving and discharging station at an existing offshore drilling platform may be provided by the addition to the platform of a waterline mooring arrangement at which a buoyant work deck unit may be moored for transfer of cargo from the deck unit to the platform safely as prevailing conditions permit, all in the absence of a vessel tied up alongside the platform. In this latter instance, it will be apparent that the work deck units used to supply cargo, stores, and equipment to an existing offshore platform must be of a buoyantly floatable nature, and that the ballast capacity of vessel 13 must be sufficient to enable the vessel to move into position under the floating work deck unit at the offshore platform.

Figure 6:
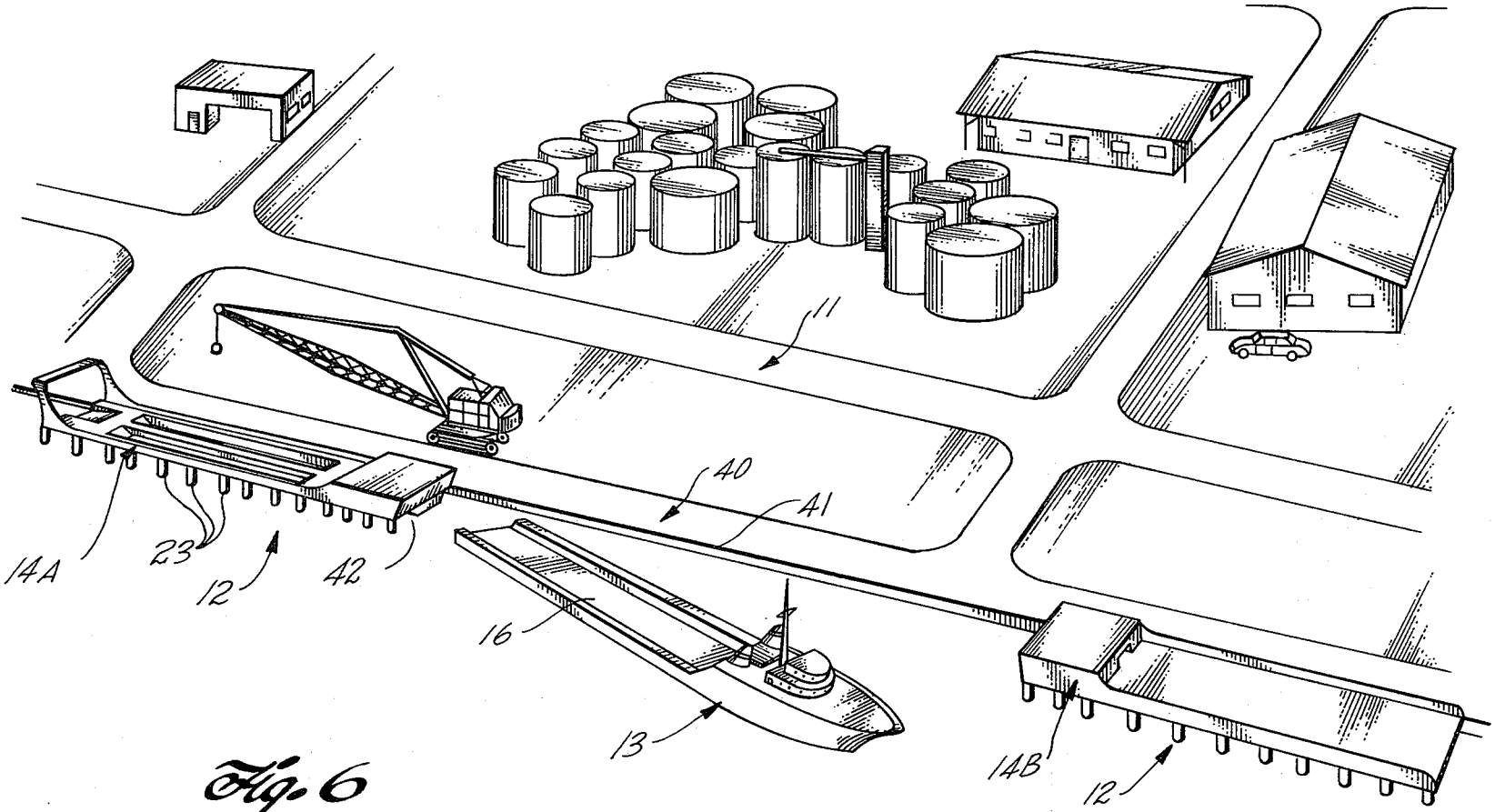
FIG. 6 is a perspective view of another dock facility.

FIG. 6 shows a supply location 11 in which the dock facilities are defined parallel to the edge 41 of a wharf 40 of the type typical along rivers. In this instance a slip 42 is defined by a row of pilings 23 parallel to the wharf edge 41 and spaced from the wharf edge by an amount corresponding to the width of a slip 20 in FIG. 2. The wharf edge and the piling ends cooperate to support a received work deck unit as shown in FIG. 6. Dock facilities of the type shown in FIG. 6 can be used to advantage on a river or the like where vessel maneuvering may be limited. An advantage of the parallel dock facility, as compared to the end-on slip arrangements shown in FIGS. 2 and 3, is that vessel 13 can pass through slip 42 in depositing a work deck unit. The different arrangements shown in FIGS. 2, 3 and 6 illustrate the flexibility and versatility of this invention.

Workers skilled in the art and technology to which this invention pertains will appreciate that the foregoing description has been presented by way of example and illustration with reference to the illustrated presently preferred embodiments and arrangements of this invention, and that the foregoing description is not an exhaustive presentation of all forms which this invention may take as to its procedural and structural aspects. Such workers will recognize that modifications, variations and adaptations may be made to the arrangements described above without departing from the fair scope and substance of this invention. For these reasons, the preceding description is not to be read or construed as limiting this invention only to the specific arrangements and procedures which have been described.

What is claimed is:

1. Apparatus for logistical support of an offshore drilling facility from a shore-based supply location comprising 1. a plurality of modular work deck units of generally rectangular plan shape and of generally uniform external configuration and dimension over the bottom and lower side and end portions thereof,
2. a self-propelled vessel having an exposed deck portion dimensioned and configured to releasably mate with and to support any one, and only one at any time, of the work deck units and cargo carried thereby in substantially laterally and longitudinally fixed position on the vessel, the vessel including ballast means operable for increasing and decreasing the draft of the vessel when mated with a work deck unit sufficiently that the vessel can ballast down from a separately supported deck unit and move out from thereunder, 3. a plurality of dock facilities at the supply location defined in cooperation with the vessel and the work deck units
   a. for movement thereinto of the vessel with a work deck unit thereon and
   b. for engaging and supporting a work deck unit therein
      i. for loading and unloading of cargo to and from the deck unit, and
      ii. for transfer to and from the vessel in response to ballasting of the vessel,
4. a deck unit-to-vessel receiving and discharging station at the offshore drilling facility,
5. the offshore drilling facility including a platform elevated above the adjacent water surface, and
6. the receiving and discharging station including elevator means at an elevated location in the drilling facility and engageable with a work deck unit, the elevator means being operable for engaging a work deck unit supported by the vessel and for raising and lowering a deck unit to and from a receiving location elevated in the offshore facility above the water surface.

2. Apparatus according to claim 1 wherein the receiving and discharging station at the offshore facility includes means operable for receiving and discharging a work deck unit from and to the vessel and for supporting a received deck unit in a non-floating state in the absence of the vessel.

3. Apparatus according to claim 1 wherein at least some of the work deck units are sufficiently buoyant that they can float stably with a load thereon, and wherein the receiving and discharging station comprises means for mooring a floating deck unit to the offshore facility.

4. Apparatus according to claim 1 wherein at least one of the deck units is configured and arranged in at least the upper aspects thereof for the stowage and handling of anchors.

5. Apparatus according to claim 1 wherein at least one of the work deck units is configured and arranged in at least the upper aspects thereof for the receipt and support of oil well tubular goods.

6. Apparatus according to claim 1 wherein at least one of the work deck units is configured and arranged in at least the upper aspects thereof for the receipt and storage of general cargo.

7. Apparatus according to claim 1 wherein at least one of the work deck units is configured and arranged in at least the upper aspects thereof for the receipt and storage of bulk goods.

8. Apparatus according to claim 1 wherein at least one of the work deck units is configured and arranged in at least the upper aspects thereof for the transport of personnel and their effects.

9. Apparatus according to claim 1 wherein the offshore facility is arranged for movement of the vessel through the facility into and out of position at the receiving and discharging station.

10. Apparatus according to claim 1 wherein the work deck units are elongated in the direction of the longitudinal extent of the vessel, and the receiving and discharging station at the offshore facility includes means for supportively engaging a work deck unit along the elongate sides thereof.

* * * * *

UNITED STATES PATENT AND TRADEMARK OFFICE

CERTIFICATE OF CORRECTION

PATENT NO. : 4,085,695

DATED : April 25, 1978

INVENTOR(S) : John J. Bylo

It is certified that error appears in the above-identified patent and that said Letters Patent are hereby corrected as shown below:

Column 2, line 24, before "1,022,374" read -- Gr. Br. --.

Column 4, line 25, after "production" read -- platform --.

Column 8, line 31, before "may" read -- room --.

Signed and Sealed this

*Twelfth* Day of *September 1978*

[SEAL]

*Attest:*

RUTH C. MASON
*Attesting Officer*

DONALD W. BANNER
*Commissioner of Patents and Trademarks*